US011825909B1

(12) United States Patent
Chaney

(10) Patent No.: US 11,825,909 B1
(45) Date of Patent: Nov. 28, 2023

(54) CUSTOMIZABLE FOOTWEAR FOR CHILDREN AND ASSOCIATED USE THEREOF

(71) Applicant: Lindsey Chaney, Brazoria, TX (US)

(72) Inventor: Lindsey Chaney, Brazoria, TX (US)

( * ) Notice: Subject to any disclaimer, the term of this patent is extended or adjusted under 35 U.S.C. 154(b) by 384 days.

(21) Appl. No.: 15/830,708

(22) Filed: Dec. 4, 2017

Related U.S. Application Data

(63) Continuation-in-part of application No. 14/171,625, filed on Feb. 3, 2014, now abandoned.

(60) Provisional application No. 61/759,741, filed on Feb. 1, 2013.

(51) Int. Cl.

| | |
|---|---|
| ***A43B 7/08*** | (2022.01) |
| ***A43B 1/00*** | (2006.01) |
| ***A43B 13/12*** | (2006.01) |
| ***A43B 13/14*** | (2006.01) |
| ***A43B 3/24*** | (2006.01) |
| ***A43B 3/30*** | (2006.01) |
| ***A43B 3/00*** | (2022.01) |

(52) U.S. Cl.
CPC ..... *A43B 7/087* (2013.01); *A43B 1/009* (2013.01); *A43B 3/0078* (2013.01); *A43B 3/242* (2013.01); *A43B 3/30* (2013.01); *A43B 13/122* (2013.01); *A43B 13/14* (2013.01)

(58) Field of Classification Search
CPC ..... A43B 7/037; A43B 7/087; A43B 1/009; A43B 3/0078
USPC ..... 36/100
See application file for complete search history.

(56) References Cited

U.S. PATENT DOCUMENTS

| | | | | |
|---|---|---|---|---|
| 7,237,345 | B2 * | 7/2007 | Thomas | A43B 1/009 36/3 A |
| 7,347,010 | B2 * | 3/2008 | Yu | A43B 1/0036 36/100 |
| 8,307,570 | B2 * | 11/2012 | Delgatty | A43B 1/0027 36/100 |
| 9,150,747 | B2 * | 10/2015 | Schilo | A43B 1/0027 |
| 9,756,894 | B2 * | 9/2017 | McDowell | A43B 7/085 |
| 2008/0216355 | A1 * | 9/2008 | Becker | A43B 13/12 36/102 |
| 2008/0289214 | A1 * | 11/2008 | Aveni | A43B 3/103 36/11.5 |
| 2010/0088928 | A1 * | 4/2010 | Sarantakos | A43C 11/1493 36/103 |
| 2010/0320102 | A1 * | 12/2010 | Schilo | A43B 1/0027 206/278 |
| 2014/0109441 | A1 * | 4/2014 | McDowell | A43B 1/0009 36/103 |

* cited by examiner

*Primary Examiner* — Alissa L Hoey
*Assistant Examiner* — Catherine M Ferreira

(57) ABSTRACT

A customizable footwear system including a footwear having a smooth, water-impermeable washable material covering a major surface area of an upper region of the footwear, and a smooth, water-impermeable outer sole extending along a lower region of the footwear and abutted against the washable material, and a plurality of orifices passing through the outer sole in such a manner that fluid and debris is channeled downwardly from the washable material, through the outer sole and out from a bottom-most surface of the outer sole.

5 Claims, 9 Drawing Sheets

CUSTOMIZABLE FOOTWEAR FOR CHILDREN AND ASSOCIATED USE THEREOF

CROSS REFERENCE TO RELATED APPLICATIONS

This is a Continuation-In-Part (CIP) Application, which claims the benefit of and priority to U.S. Non-provisional patent application Ser. No. 14/171,625, filed Feb. 3, 2014, which claims the benefit of and priority to U.S. Provisional Application No. 61/759,741, filed Feb. 1, 2013, the entire disclosures of which are incorporated by reference herein.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

Technical Field

Exemplary embodiment(s) of the present disclosure relate to customizable footwear and, more particularly, to customizable footwear including washable colored markers for providing children a stylish new accessory as well as a creative outlet with which a child could express their own interests and style on the footwear.

Prior Art

One of the most prevalent methods used by children and teens to assert an independent sense of self is through fashion. Even following the latest trends, whether it is casual shorts and tees offered by GAP KIDS®, or brightly colored sweaters from LIMITED TOO®, young consumers feel that being able to decide for themselves what they wear is a direct indication of individuality. Particularly, the childhood and tween years are a time when experimentation in fashion can be the rule of the day. Not surprisingly, adventurous youngsters often enjoy creating their own looks that may not be particularly appreciated by adults, but nonetheless provide a simple means of telling the world, "This is what I like, and a reflection of who I am."

Accordingly, a need remains for customizable footwear in order to overcome at least one prior art shortcoming. The exemplary embodiment(s) satisfy such a need by providing customizable footwear including washable colored markers that is convenient and easy to use, lightweight yet durable in design, versatile in its applications, and designed for providing children a stylish new accessory as well as a creative outlet with which a child could express their own interests and style on the footwear.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a customizable footwear system for providing user enjoyment. These and other objects, features, and advantages of the non-limiting exemplary embodiment(s) are provided by a customizable footwear system including a footwear having a smooth, water-impermeable washable material covering a major surface area of an upper region of the footwear, and a smooth, water-impermeable outer sole extending along a lower region of the footwear and abutted against the washable material, and a plurality of orifices passing through the outer sole in such a manner that fluid and debris is channeled downwardly from the washable material, through the outer sole and out from a bottom-most surface of the outer sole.

In a non-limiting exemplary embodiment, the system further includes at least one marker including washable ink. Such washable ink is removably displayed on the washable material and the outer sole of the footwear wherein the washable ink is discharged downwardly through the orifices when diluted with water.

In a non-limiting exemplary embodiment, each of the orifices includes an inlet formed at a top most surface of the outer sole, and an outlet formed at a bottom most surface of the outer sole.

In a non-limiting exemplary embodiment, each of the orifices is abutted against an outer surface of the washable material and spaced inwardly from an outer surface of the outer sole.

In a non-limiting exemplary embodiment, a top most surface of the outer sole includes a shoulder extending outwardly and away from the washable material. Such a shoulder is disposed at a junction of the washable material and the outer sole.

In a non-limiting exemplary embodiment, the inlet is disposed at the shoulder.

In a non-limiting exemplary embodiment, the outer sole is bifurcated into a first layer and a second layer horizontally stacked thereon.

In a non-limiting exemplary embodiment, the orifices continuously pass through each of the first and second layers.

The present disclosure further includes a method of utilizing a customizable footwear system for providing user enjoyment, the method includes the initial step of: providing a footwear including a smooth, water-impermeable washable material covering a major surface area of an upper region of the footwear, and a smooth, water-impermeable outer sole extending along a lower region of the footwear and abutted against the washable material, and a plurality of orifices passing through the outer sole. The next step includes channeling fluid and debris downwardly from the washable material, through the outer sole and out from a bottom-most surface of the outer sole.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
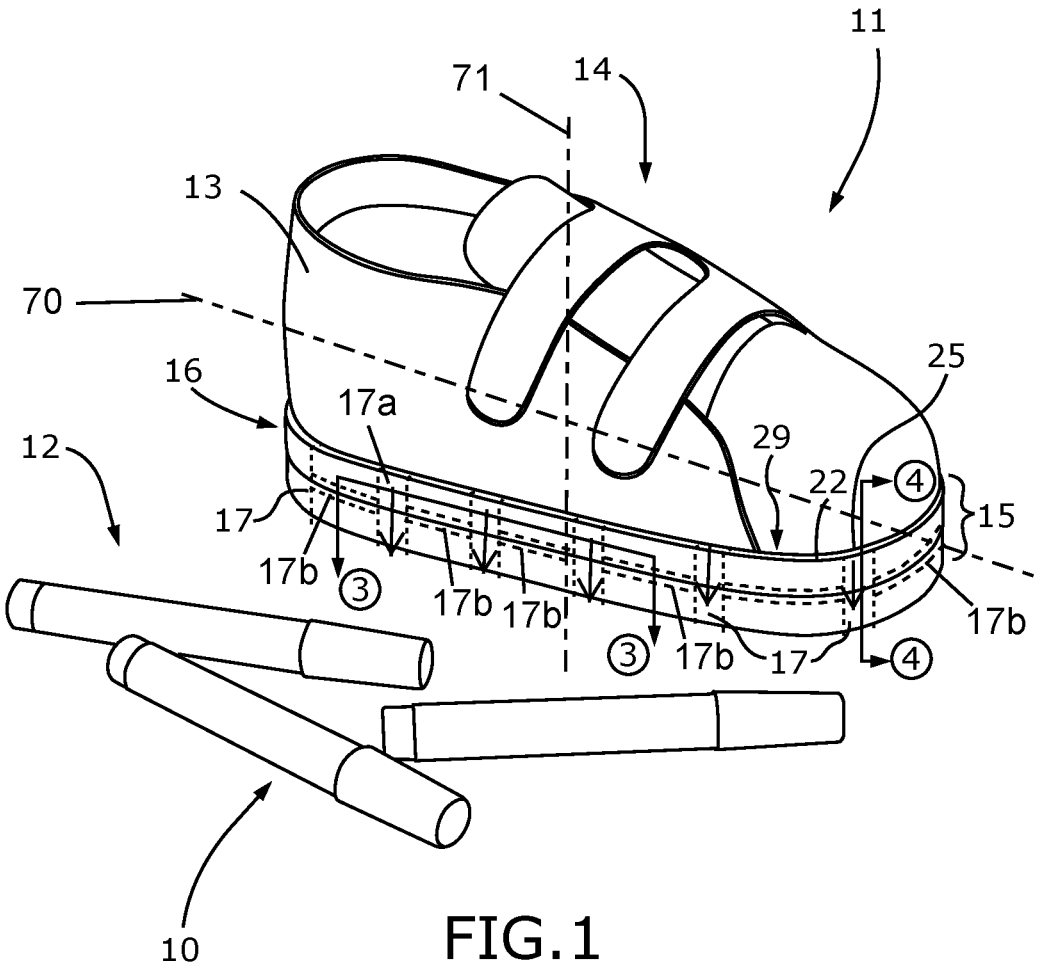
FIG. 1 is a perspective view of a customizable footwear system including drainage orifices passing through the outer sole, in accordance with a non-limiting exemplary embodiment.
Figure 2:
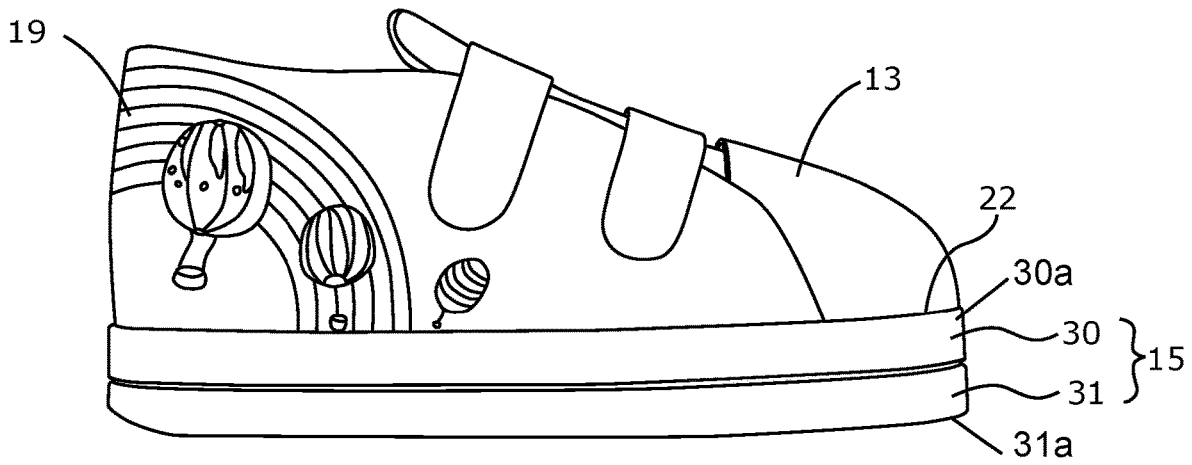
FIG. 2 is a side-elevational view of the customizable footwear shown in FIG. 1.
Figure 3:
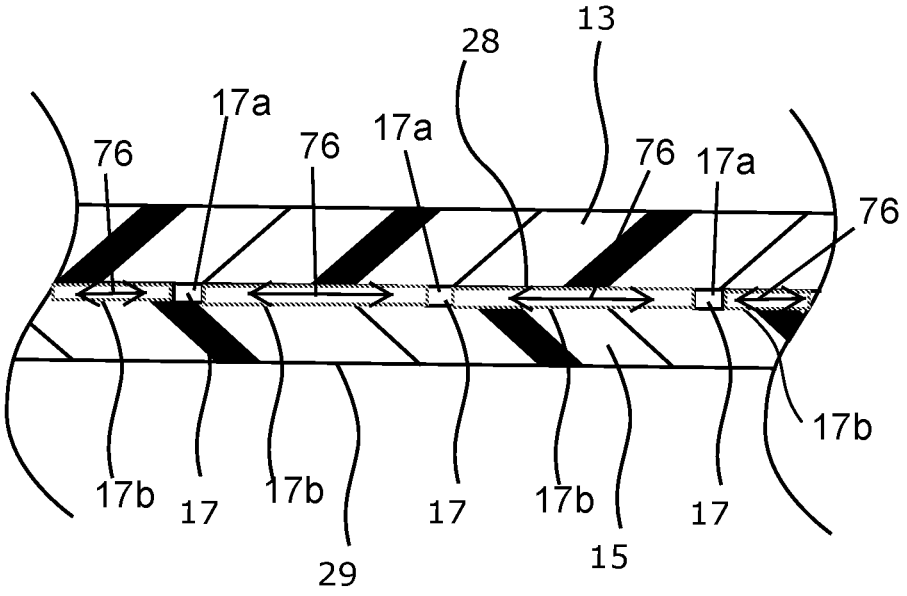
FIG. 3 is an enlarged cross-sectional view of exemplary orifices taken along line 3-3 shown in FIG. 1.
Figure 4:
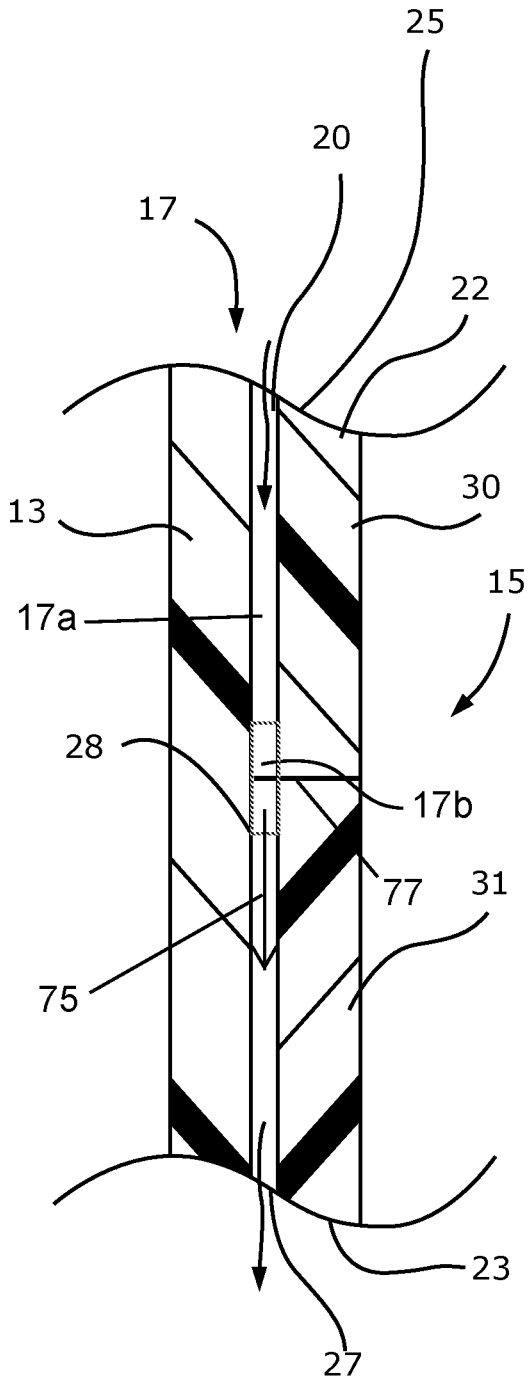
FIG. 4 is an enlarged cross-sectional view of an exemplary orifice taken along line 4-4 shown in FIG. 1.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

The non-limiting exemplary embodiment(s) is/are referred to generally in FIGS. 1-9 and is/are intended to provide a customizable footwear system 10 including a footwear 11 having a smooth, water-impermeable washable material 13 covering a major surface area of an upper region 14 of the footwear 11, and a smooth, water-impermeable outer sole 15 extending along a lower region 16 of the footwear 11 and abutted against the washable material 13, and a plurality of orifices 17 passing through the outer sole 15 in such a manner that fluid and debris is channeled downwardly from the washable material 13, through the outer sole 15 and out from a bottom-most surface 23 of the outer sole 15.

In a non-limiting exemplary embodiment, the system 10 further includes at least one marker 12 including washable ink 19. Such washable ink 19 is removably displayed on the washable material 13 and the outer sole 15 of the footwear 11 wherein the washable ink 19 is discharged downwardly through the orifices 17 when diluted with water.

In a non-limiting exemplary embodiment, each of the orifices 17 includes an inlet 20 formed at a top most surface 22 of the outer sole 15, and an outlet 27 formed at the bottom most surface 23 of the outer sole 15.

In a non-limiting exemplary embodiment, each of the orifices 17 is abutted against an outer surface 28 of the washable material 13 and spaced inwardly from an outer surface 29 of the outer sole 15.

In a non-limiting exemplary embodiment, a top most surface 22 of the outer sole includes a shoulder 25 extending outwardly and away from the washable material 13. Such a shoulder 25 is disposed at a junction 29 of the washable material 13 and the outer sole 15.

In a non-limiting exemplary embodiment, the inlet 20 is disposed at the shoulder 25.

In a non-limiting exemplary embodiment, the outer sole 15 is bifurcated into a first layer 30 and a second layer 31 horizontally stacked thereon.

In a non-limiting exemplary embodiment, the orifices 17 continuously pass through each of the first and second layers 30, 31.

The present disclosure further includes a method of utilizing a customizable footwear system 10 for providing user enjoyment. Such a method includes the initial step of: providing a footwear 11 including a smooth, water-impermeable washable material 13 covering a major surface area of an upper region 14 of the footwear 11, and a smooth, water-impermeable outer sole 15 extending along a lower region 16 of the footwear 11 and abutted against the washable material 13, and a plurality of orifices 17 passing through the outer sole 15. The next step includes channeling fluid and debris downwardly from the washable material 13, through the outer sole 15 and out from a bottom-most surface 23 of the outer sole 15.

Referring again to FIGS. 1-9, the customizable footwear 11 system 10 includes a footwear 11 having a centrally registered longitudinal axis 70 and a centrally registered latitudinal axis 71 traversed therewith. The footwear 11 includes a washable material 13 covering a major surface area of an upper region 14 of the footwear 11, an outer sole 15 extended along a lower region 16 of the footwear 11 and directly abutted against the washable material 13, and a plurality of orifices 17 advantageously passing through the outer sole 15 in such a manner that fluid and debris are channeled downwardly from the washable material 13, through the outer sole 15 and out from a bottom-most surface 23 of the outer sole 15. Advantageously, the outer sole 15 is bifurcated into a first layer 30 and a second layer 31 directly positioned beneath the first layer 30. Notably, the second layer 31 is configured substantially parallel to the first layer 30 wherein each of the first layer 30 and the second layer 31 contiguously extends along an entire outer perimeter of the outer sole 15. In this manner, the first layer 30 is a top-most layer 30*a* and the second layer 31 is a bottom-most layer 31*a* directly engaged thereagainst. Advantageously, each of the top-most layer 30*a* and the bottom-most layer 31*a* has a smooth and continuous entire outer perimeter.

In a non-limiting exemplary embodiment, the plurality of orifices 17 include a plurality of primary orifices 17*a* oriented parallel to the centrally registered latitudinal axis 71, and a plurality of secondary orifices 17*b* oriented parallel to the centrally registered longitudinal axis 70. Advantageously, the secondary orifices 17*b* are intercalated and interconnected to the primary orifices 17*a*, respectively, such that the fluid and debris travel along both vertical paths 75 and horizontal paths 76 defined along the primary orifices 17*a* and the secondary orifices 17*b*, respectively. Such a structural configuration provides the unexpected and unpredictable advantage of evenly and effectively channeling fluid and debris away from the outer sole 15.

In a non-limiting exemplary embodiment, the vertical paths 75 are unidirectional and travel downwardly from the top-most layer 30*a* to the bottom-most layer 31*a*. Advantageously, the horizontal paths 76 are bi-directional and travel forwardly towards a toe-retaining portion of the footwear 11 as well as rearwardly towards a heal-retaining portion of the footwear 11.

In a non-limiting exemplary embodiment, the secondary orifices 17*b* are disposed along a junction 77 of the top-most layer 30*a* and the bottom-most layer 31*a*.

In a non-limiting exemplary embodiment, the primary orifices 17*a* are fluidly connected directly to the secondary orifices 17*b* and configured in a web-like pattern along an entire longitudinal length of the outer sole 15.

In a non-limiting exemplary embodiment, the secondary orifices 17*b* are oriented perpendicular to the primary orifices 17*a*.

Figure 5:
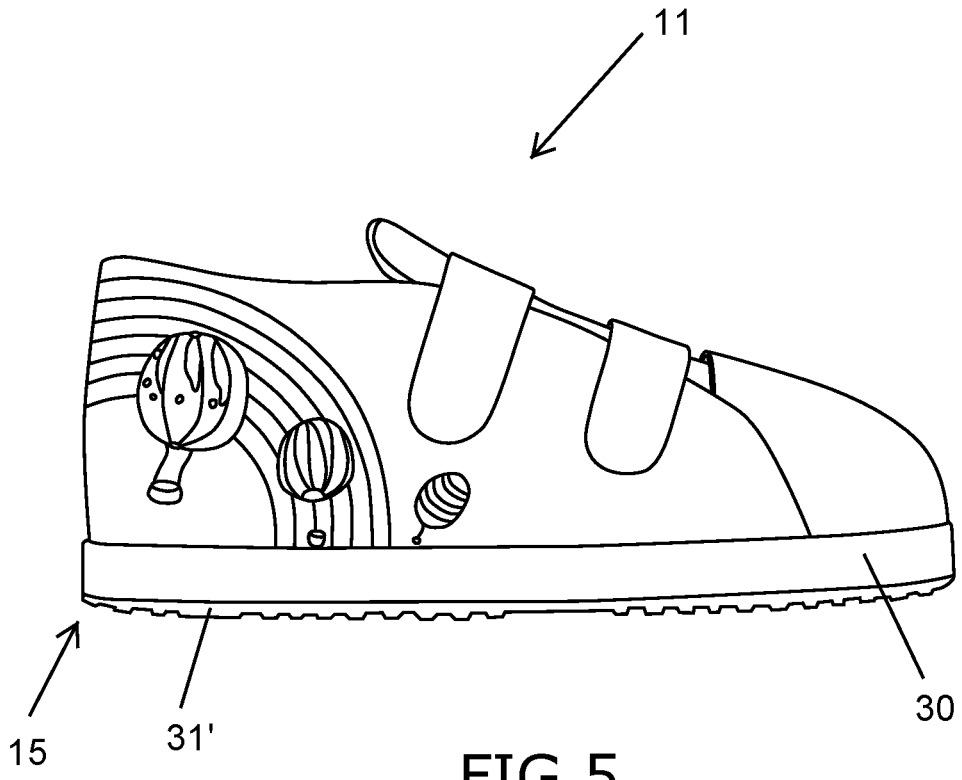
FIG. 5 is a perspective view of a customizable footwear system wherein the first layer is thicker than the second layer.
Figure 6:
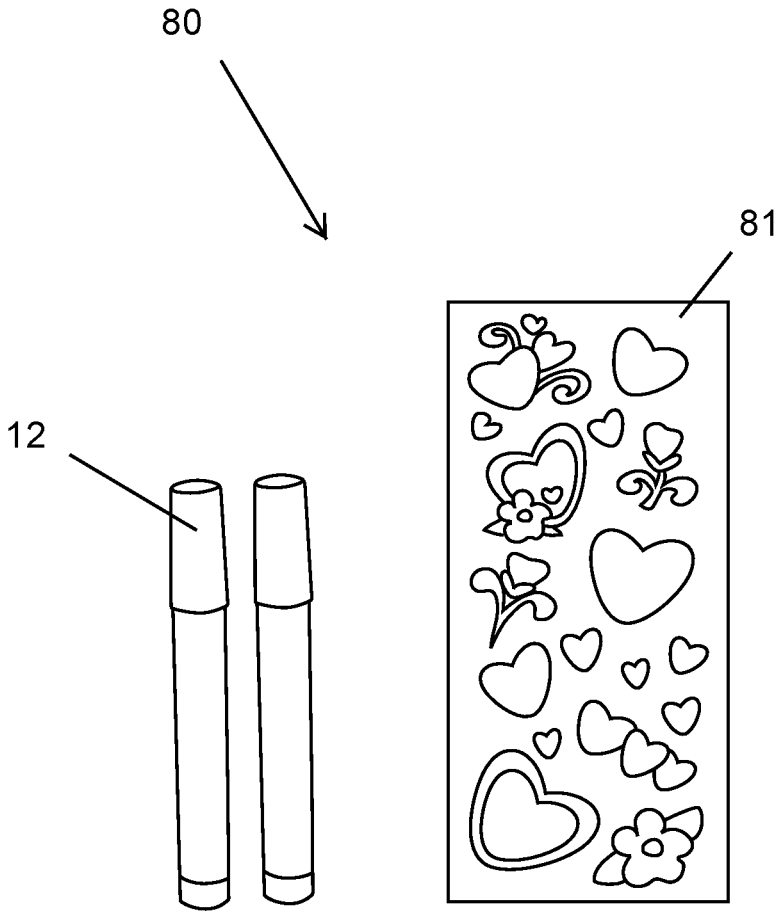
FIG. 6 is front elevational view showing a plurality of washable drawing accessories for personalizing the footwear.
Figure 7:
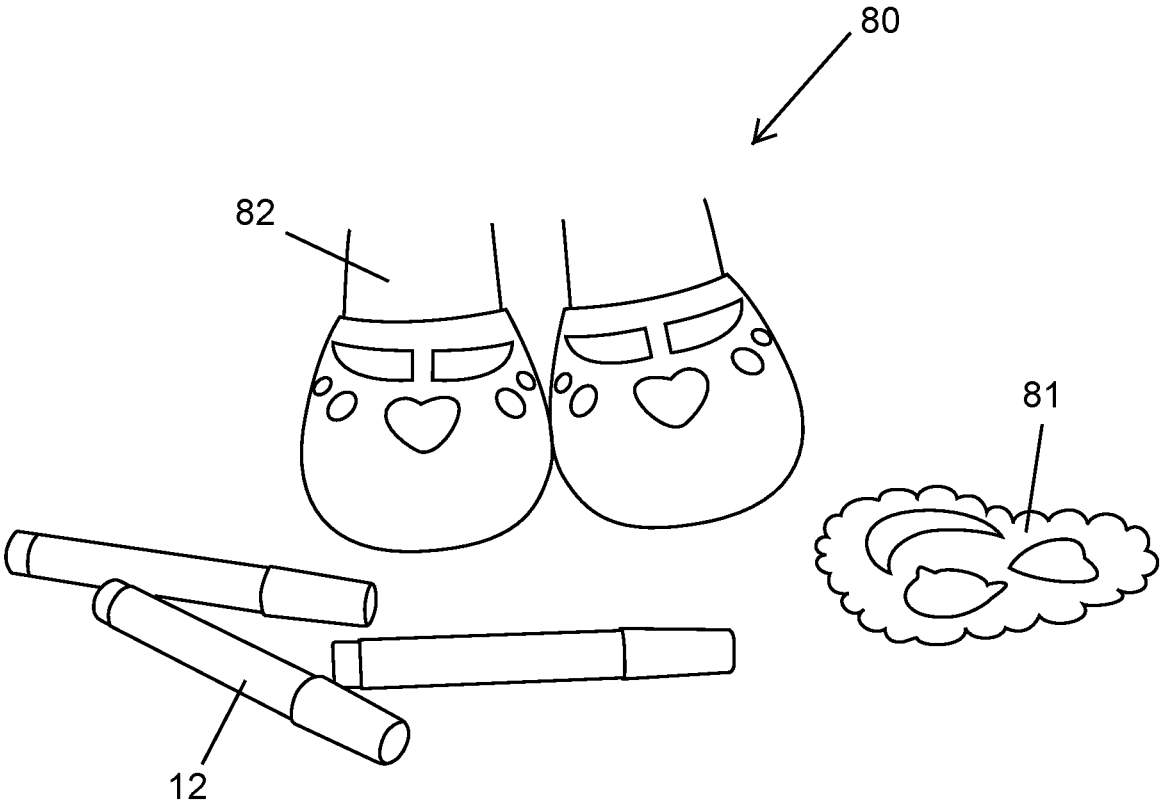
FIG. 7 is a perspective view showing stampers, predefined templates, and washable markers for personalizing the footwear.
Figure 8:
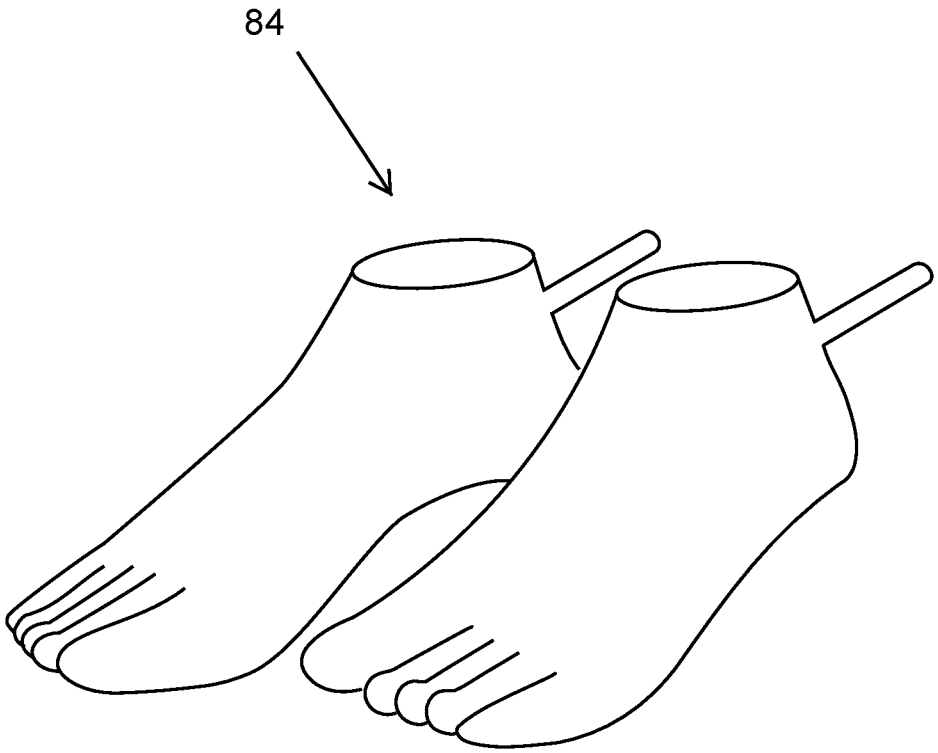
FIG. 8 is a perspective view showing a pair of footwear holders for assisting a user to position the footwear at a desired angle during drawing and cleaning procedures.
Figure 9:
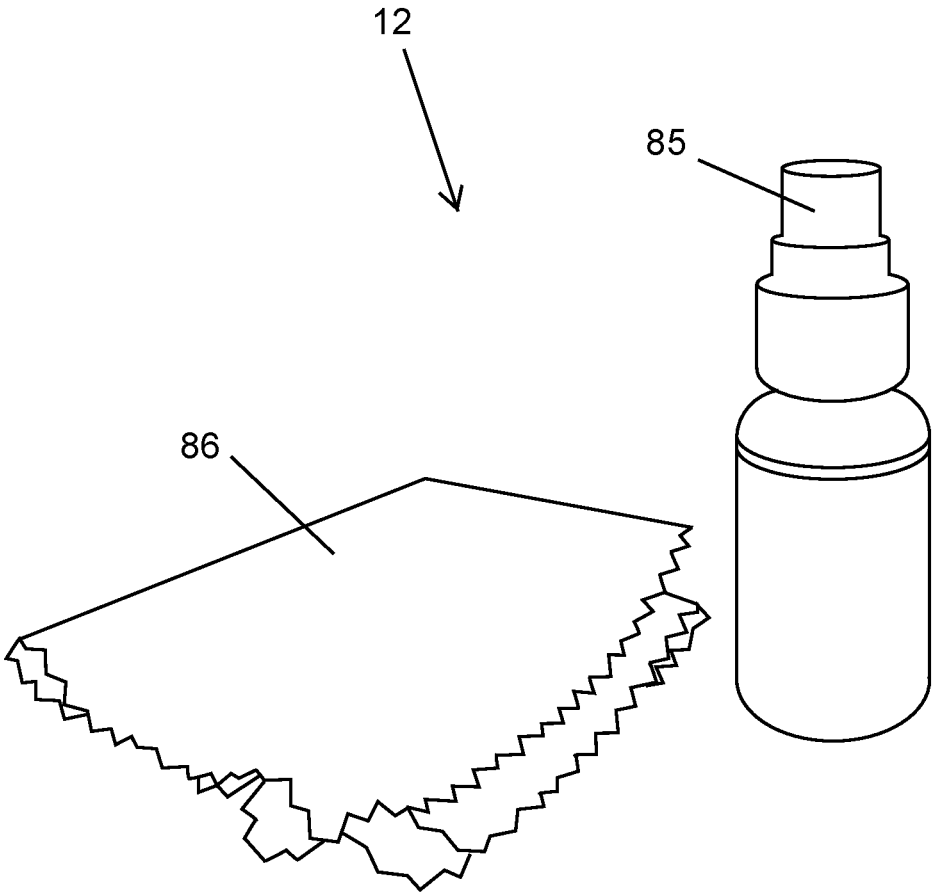
FIG. 9 is a perspective view showing a cleaning agent and dispenser with a cloth wipe to remove drawings and other personalized surface indicia from the footwear.

FIG. 5 illustrates a non-limiting exemplary embodiment of a customizable footwear system wherein the first layer 30 is thicker than the second layer 31'.

In a non-limiting exemplary embodiment, the footwear system 10 further includes at least one marker 12 having washable ink 19, which is removably displayed on the washable material 13 and the outer sole 15 of the footwear 11. Advantageously, the washable ink 19 is discharged downwardly through the primary orifices 17*a* and secondary orifices 17*b* when diluted with water. FIGS. 6-9 show a plurality of accessories 80 that can be used to assist a user during decorating and cleaning procedures. For example, markers 12, stencils 81, stampers 82, plastic/wooden footwear holders 84, cleaning agents 85, and cloth wipes 86 can be employed by the present disclosure.

In a non-limiting exemplary embodiment, each of the primary orifices 17*a* includes an inlet 20 formed at a top most surface 22 of the outer sole 15, and an outlet 27 formed at a bottom most surface 23 of the outer sole 15.

In a non-limiting exemplary embodiment, each of the primary orifices 17*a* and the secondary orifices 17*b* is abutted against an outer surface 28 of the washable material 13 and spaced inwardly from an outer surface 29 of the outer sole 15.

In a non-limiting exemplary embodiment, a top most surface 22 of the outer sole includes a shoulder 25 extending outwardly and away from the washable material 13, wherein the shoulder 25 is disposed at a junction 29 of the washable material 13 and the outer sole 15.

In a non-limiting exemplary embodiment, the inlet 20 is disposed at the shoulder 25.

In a non-limiting exemplary embodiment, the primary orifices 17*a* continuously pass through each of the first and second layers 30, 31, while the secondary orifices 17*b* are intercalated between the top-most layer 30*a* and the bottom-most layer 31*a*.

A non-limiting exemplary embodiment of the present disclosure is referred to generally in the figures and is intended to provide customizable footwear 11 including washable colored markers 12 for providing children a stylish new accessory as well as a creative outlet with which a child could express their own interests and style on the footwear 11. It should be understood that the exemplary embodiment may be used to customize many different types of footwear 11, and should not be limited to any particular footwear 11 described herein.

Referring to the figures in general, in a non-limiting exemplary embodiment, customizable footwear 11 include washable colored markers 12 for providing children a stylish new accessory as well as a creative outlet with which a child could express their own interests and style on the footwear 11. Such customizable footwear 11 may be embodied in a line of stylish sneakers, on which a child can draw or create a wide variety of customized designs with washable colored markers 12 included for sale with each pair. Offered in standard shoes sizes that would be appropriate for wear by young children to tweens, the customizable footwear 11 would be a standard high-top or low top sneaker shoe, with styles made available that would appeal to male and female children alike. The customizable footwear 11 could boast a shock absorbing rubber sole, with the upper of the shoe manufactured of a durable polyester material featuring a smooth, writable surface. The customizable footwear 11 could be held in place over the foot by way of laces boasting reinforced eyelet fasteners, or these stylish sneakers could be easily secured by way of a durable, self-affixing VELCRO® straps.

A notable aspect of the customizable footwear 11 is that these shoes could be easily customized by the wearer. As mentioned, the polyester that forms the upper of the shoe would be feature a smooth and writable surface 13, as would the rubber that forms the outer sides of the sole 15. For practical purposes, these surfaces could be white in color, thus providing the child a blank canvas on which to unleash their imaginations. Such surfaces 13, 15 could be washed and reused multiple times, thus enabling the child to frequently change the design of the shoe as so desired. Included with each pair of customizable footwear 11 would be a complete set of washable colored markers 12. These markers 12 could be offered in age-appropriate configurations. For instance, markers 12 included for sale with shoes worn by younger children might feature a larger barrel and wide marking head to facilitate easy handling by the child, while markers 12 included with shoes sized appropriately for wear by tweens might be more streamlined and feature a precision drawing tip. In either case, basic colors such as yellow, red, green, blue, orange, purple, brown and black could be included in each marker set, while alternate color options could also be made available and sold separately alongside the unit.

Use and application of the customizable footwear 11 would be very simple and straightforward. In a non-limiting exemplary embodiment, a user would purchase a pair of customizable footwear 11 sneakers in accordance to size and design preference of their child. Once purchased, the parent would simply offer the sneakers and the markers 12 to their child and the child could then begin to draw on the shoes. Utilizing the markers 12, the child might write their name on the side of the sole, drawing stars, hearts and flowers on the polyester upper of the shoe. Alternately, one may adorn their customizable footwear 11 with an abstract pattern, a friendly dinosaur or even a scary shark. With the customizable footwear 11 adorned with colorful, hand drawn renderings, the child would then simply don their sneakers, enjoying the striking new look that they themselves had created. As desired, the customizable footwear 11 could be washed clean and a new design could be rendered on the shoe. As mentioned, the customizable footwear 11 could be washed multiple times, thus enabling the child to repeatedly change or update the shoes as often as the mood strikes.

The customizable footwear 11 is an innovative product that offers children and teens many significant benefits and advantages. For example, provides young people with a fun and creative outlet for expression through fashion. A specially designed line of sneakers that can be easily customized with washable colored markers 12 included for sale with each pair, the customizable footwear 11 would enable children to express their individuality and creativity in a fun and exciting manner. Providing a blank canvas, colorful markers 12 and endless design possibilities, the customizable footwear 11 would enable the child to create truly unique pieces of art, via their footwear 11. As such, this versatile line of sneakers would allow children and teens to visibly display a comfortable, casual new look that is highly unique in the world of fashion. In this manner, the customizable footwear 11 would offer a simple, affordable way to buck current trends while maintaining one's own personal style. Children should especially appreciate that the writable surface of the shoe would be washable, thus enabling them to easily update or change the design as often as they like.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A customizable footwear system for providing user enjoyment, said customizable footwear system comprising: a footwear having a centrally registered longitudinal axis and a centrally registered latitudinal axis traversed therewith, said footwear including a washable material covering a major surface area of an upper region of said footwear;

an outer sole extended along a lower region of said footwear and directly abutted against said washable material; and a plurality of orifices passing through said outer sole in such a manner that fluid and debris are channeled downwardly from said washable material, through said outer sole and out from a bottom most surface of said outer sole;

wherein said outer sole is bifurcated into a first layer and a second layer directly positioned beneath said first layer, wherein said second layer is configured substantially parallel to said first layer, wherein each of said first layer and said second layer contiguously extend along an entire outer perimeter of said outer sole, wherein said first layer is a top most layer and said second layer is a bottom most layer directly engaged thereagainst, wherein said bottom most layer has a smooth and continuous entire outer perimeter;

wherein said plurality of orifices include a plurality of primary orifices oriented parallel to the centrally registered latitudinal axis, and a plurality of secondary orifices oriented parallel to the centrally registered longitudinal axis;

wherein said secondary orifices are intercalated and interconnected to said primary orifices, respectively, such that the fluid and debris travel along both vertical paths and horizontal paths defined along said primary orifices and said secondary orifices, respectively;

wherein said vertical paths are unidirectional and travel downwardly from said top most layer to said bottom most layer, wherein said horizontal paths are bidirectional and travel forwardly towards a toe retaining portion of said footwear as well as rearwardly towards a heal retaining portion of said footwear;

wherein said secondary orifices are disposed along a junction of said top most layer and said bottom most layer;

wherein said primary orifices are fluidly connected directly to said secondary orifices and configured in a web-like pattern along an entire longitudinal length of said outer sole;

wherein said secondary orifices are oriented perpendicular to said primary orifices;

at least one marker including washable ink, said washable ink being removably displayed on said washable material and said outer sole of said footwear, wherein said washable ink is discharged downwardly through said orifices when diluted with water;

wherein each of said primary orifices include an inlet formed at a top most surface of said outer sole, and an outlet formed at a bottom most surface of said outer sole.

2. The customizable footwear system of claim 1, wherein each of said primary orifices and said secondary orifices is abutted against an outer surface of said washable material and spaced inwardly from an outer surface of said outer sole.

3. The customizable footwear system of claim 2, wherein a top most surface of said outer sole comprises: a shoulder extending outwardly and away from said washable material, said shoulder being disposed at a junction of said washable material and said outer sole.

4. The customizable footwear system of claim 3, wherein said inlet is disposed at said shoulder.

5. The customizable footwear system of claim 4, wherein said primary orifices continuously pass through each of said first and second layers while said secondary orifices are intercalated between said top most layer and said bottom most layer.

* * * * *